US012115424B2

(12) United States Patent
Zamansky et al.

(10) Patent No.: US 12,115,424 B2
(45) Date of Patent: Oct. 15, 2024

(54) BACKBOARD AND NET ASSEMBLY FOR SPORTS PLAY

(71) Applicants: Mia Pink Zamansky, Hopkins, MN (US); Noah Franklin Zamansky, Hopkins, MN (US)

(72) Inventors: Mia Pink Zamansky, Hopkins, MN (US); Noah Franklin Zamansky, Hopkins, MN (US)

( * ) Notice: Subject to any disclaimer, the term of this patent is extended or adjusted under 35 U.S.C. 154(b) by 17 days.

(21) Appl. No.: 17/405,684

(22) Filed: Aug. 18, 2021

(65) Prior Publication Data

US 2023/0056210 A1 Feb. 23, 2023

(51) Int. Cl.
*A63B 63/08* (2006.01)
*A63B 49/03* (2015.01)

(52) U.S. Cl.
CPC ..... *A63B 63/083* (2013.01); *A63B 49/03* (2015.10); *A63B 2225/09* (2013.01)

(58) Field of Classification Search
CPC ..... A63B 67/002; A63B 63/083; A63B 63/00; A63B 2225/09; A63B 49/03
See application file for complete search history.

(56) References Cited

U.S. PATENT DOCUMENTS 323,843 A * 8/1885 Armington ..... A63B 65/125 124/79
335,656 A * 2/1886 Taylor ..... A63B 49/02 473/526
613,383 A * 11/1898 Morgan ..... A63B 67/06 273/402
1,156,047 A * 10/1915 Behrend ..... A63B 65/125 124/79
1,184,822 A * 5/1916 Caplette ..... A63B 59/20 273/354
1,419,554 A * 6/1922 Ganse ..... A63B 67/002 273/400
1,695,937 A * 12/1928 Welch ..... A63F 9/02 273/357
1,930,281 A * 10/1933 Ogden ..... A63B 59/40 473/525
2,008,359 A * 7/1935 Lamb ..... A63F 9/0208 273/342
2,051,476 A * 8/1936 Grant ..... A63F 9/02 273/342

(Continued)

FOREIGN PATENT DOCUMENTS

CN 205284742 U * 6/2016
DE 3329411 A1 * 2/1985

(Continued)

OTHER PUBLICATIONS

CN 205284742 U (Year: 2016).*
DE 3329411 A1 (Year: 1985).*

*Primary Examiner* — Melba Bumgarner
*Assistant Examiner* — Amir A Klayman
(74) *Attorney, Agent, or Firm* — Z. Peter Sawicki; Amanda M. Prose; Westman, Champlin & Koehler, PA.

(57) ABSTRACT

A game assembly and method of game play with an adjustable assembly including a tennis racket, a net supported on a handle, and a game ball. The net and the tennis racket are interconnected to form a backboard and hoop for receiving the game ball. The assembly may be wall mountable with adhesive strips.

4 Claims, 2 Drawing Sheets

(56) References Cited

U.S. PATENT DOCUMENTS 2,242,122 A * 5/1941 Glover ..... A63B 65/122 473/515
2,247,852 A * 7/1941 Saunders ..... A63B 63/083 224/648
2,301,265 A * 11/1942 Fandrey ..... A63F 7/0612 273/342
2,926,914 A * 3/1960 Miller ..... A63F 7/305 273/389
D210,543 S * 3/1968 Nakayama ..... D21/722
3,488,056 A * 1/1970 Sramek ..... A63B 67/083 473/509
3,602,504 A * 8/1971 Chapman ..... A63B 61/003 248/219.3
3,622,155 A * 11/1971 Hirsch ..... A63B 63/083 473/481
3,887,184 A * 6/1975 Cavaliere ..... A63B 67/083 473/515
3,951,409 A * 4/1976 Drohomirecky ..... A63B 63/08 273/342
4,139,961 A * 2/1979 Markos ..... A01K 77/00 43/12
4,262,948 A * 4/1981 Emme ..... A01K 23/005 294/1.5
4,286,717 A * 9/1981 Liesinger ..... B25H 3/04 211/89.01
4,368,890 A * 1/1983 Horstman ..... A63B 60/10 273/DIG. 8
4,746,119 A * 5/1988 Jeanrot ..... A63B 60/54 473/531
4,790,529 A * 12/1988 Pelle ..... A63B 21/0628 273/129 Q
4,828,270 A * 5/1989 Chiang ..... A63B 63/00 273/401
4,889,341 A * 12/1989 Walker ..... A63B 63/00 473/165
4,936,578 A * 6/1990 Hudson, Sr. ..... A63B 63/00 473/439
4,948,150 A * 8/1990 Daly, Jr. ..... A63B 69/0079 473/430
4,973,054 A * 11/1990 Metrosky ..... A63B 21/1663 473/481
5,098,108 A * 3/1992 McKinney ..... A63B 63/083 383/117
5,157,854 A * 10/1992 Rumsey, Jr. ..... A01K 77/00 43/4
5,192,080 A * 3/1993 Duncan ..... A63B 63/083 273/412
5,224,703 A * 7/1993 Osher ..... A63B 60/10 124/20.1
D343,215 S 1/1994 Grant
D343,883 S 2/1994 Hall
5,299,800 A * 4/1994 Daniels ..... A63B 63/083 473/481
5,306,018 A * 4/1994 Talbot ..... A63B 60/50 473/503
5,346,228 A * 9/1994 Offutt ..... A63B 63/00 473/477
5,524,881 A 6/1996 Edward
5,533,724 A * 7/1996 Choi ..... A63B 49/00 473/527
5,570,879 A * 11/1996 Glancey ..... A63B 63/00 473/472
5,593,143 A * 1/1997 Ferrarin ..... E04H 17/08 248/74.1
5,829,751 A * 11/1998 Willis ..... A63B 67/22 273/330
6,648,780 B1 * 11/2003 Boldin ..... A63B 69/385 473/422
6,958,022 B2 * 10/2005 O'Neill ..... A63B 63/083 473/481
7,223,186 B2 * 5/2007 Tresvant ..... A63B 69/0071 473/433
7,281,999 B1 * 10/2007 Miller ..... A63B 63/083 D21/705
7,546,990 B1 * 6/2009 McGuire ..... B25H 3/04 248/113
7,914,402 B2 * 3/2011 Gaudin ..... A63B 69/0097 473/478
8,356,443 B1 * 1/2013 Hume ..... A01K 77/00 43/11
8,820,841 B2 * 9/2014 Donley ..... A47C 4/03 297/440.13
8,857,098 B2 * 10/2014 Marks ..... A01K 77/00 43/12
8,992,277 B2 * 3/2015 Macias ..... A63B 60/10 441/74
9,179,789 B1 * 11/2015 Fitzgerald ..... A63C 11/028
9,393,474 B2 * 7/2016 Smejkal ..... A63B 69/002
9,427,643 B2 * 8/2016 Kidd, III ..... A63B 63/00
9,901,245 B2 * 2/2018 Kovarik ..... A61B 1/0676
10,926,150 B2 * 2/2021 Yablonowski ..... A63B 21/023
11,213,731 B1 * 1/2022 Anderson ..... A63B 63/004
2002/0111234 A1 * 8/2002 MacNichol ..... A63B 63/00 273/408
2003/0034611 A1 * 2/2003 Lacy ..... A63F 7/0612 273/317.3
2008/0115400 A1 * 5/2008 Capio ..... A01K 63/006 43/7
2010/0013251 A1 * 1/2010 Yang ..... A01K 23/005 294/1.3

FOREIGN PATENT DOCUMENTS

GB 191211067 A * 1/1913
WO WO-0166200 A1 * 9/2001 ..... A63B 59/80
WO WO 2005105224 A1 * 11/2005
WO 2018/147920 A1 8/2018

* cited by examiner

BACKBOARD AND NET ASSEMBLY FOR SPORTS PLAY

BACKGROUND

The present invention relates to a net and backboard assembly that can be mounted on various surfaces at selected heights and positioning for playing a modified basketball-like game.

Sporting equipment for casual play of "ball in net" games in the style of basketball are devices generally including a backboard and rim in a fixed assembly, with or without a stand. Those devices that are wall mountable generally are mounted with the backboard flush to the wall. In the event these assemblies are portable, they are clunky, include large pieces and/or require tools for disassembly, reassembly and/or installation.

SUMMARY

An aspect of the present disclosure relates to an assembly for game play. The assembly is a backboard comprising a backboard handle and head having a stringed surface, with an open throat connecting the handle to the head and a mounting surface on a distal end of the backboard handle; and a net comprising a net ring supporting a net thereon and a net handle extending from connection with the net ring with a mounting surface on an opposing end of the net handle. The net and the backboard are interconnected with the net handle extending through the open throat such that the net and backboard are connected at the open throat and the net ring respectively. An angle between stringed surface of the head and a plane of the net ring is adjustable when mounting the assembly to an upright surface.

A fastener secures the interconnected position of the backboard and net.

The fastener is a bolt or screw.

The assembly is mounted to the upright surface at each of the mounting surfaces of the net and backboard with a bolt or screw.

The assembly is adjustable when mounting the assembly to the upright surface by selecting a spacing between each of the mounting surfaces of the net and backboard.

The backboard handle and the net handle both extend rearwardly from the interconnected net and backboard.

The backboard is a tennis racket.

The net is a butterfly net or fishing net and further comprises an opening opposing the net ring to provide a hole at a bottom of the net.

Another aspect of the present disclosure relates to a method of game play. The method includes inserting a first end of a handle connected to a net ring and net into a throat opening of a tennis racket until the net ring meets the throat opening; securing the first end of the handle to an upright surface at a first location and securing a distal end of a handle of the tennis racket to the upright surface at a second location. Mounting includes selecting a distance between the first location and a second location to adjust the positioning of a head of the tennis racket with respect to a plane or the net ring.

Securing the net right in the throat opening is done with an adhesive strip.

Securing each handle to the first and second location respectively is done with a bolt or screw.

Game play includes using the head of the tennis racket as a backboard for shooting a game ball into the net.

Yet another aspect of the present disclosure relates to a game assembly comprising a tennis racket; a net supported on a handle; and a game ball. The net and the tennis racket are interconnected to form a backboard and hoop for receiving the game ball.

DETAILED DESCRIPTION

The assembly of the present disclosure is a portable assembly that can be assembled easily, quickly and with or without tools. The assembly can be used for playing casual basketball-like games of the style of shooting a ball into a net. The assembly is a two or more component assembly that is mountable on nearly any surface, whether substantially flat or having uneven surfaces, upright or angled, or otherwise comprised of a material not easily modified with insertable fastening systems such as nails or screws.

The assembly may be referred to as a portable modified basketball game assembly. However, game play with the assembly is not so limited. Various game balls such as mini basketballs whose diameter is about 6 inches would typically be used but any small ball that is handled with one hand by a typical child is contemplated for use. Standard basketball rules can be used to play, however, any other rules even rules made up by the players can be used to govern the use of the assembly described herein.

The assembly is also adjustable in that mounting of the assembly can selectively adjust or modify an angle between the two components. The two components include a backboard component and a net component. The backboard component may be positioned with respect to the net component at an angle other than 90 degrees. The net and backboard component are also spaced apart from a mounting surface when installed.

Figure 1:
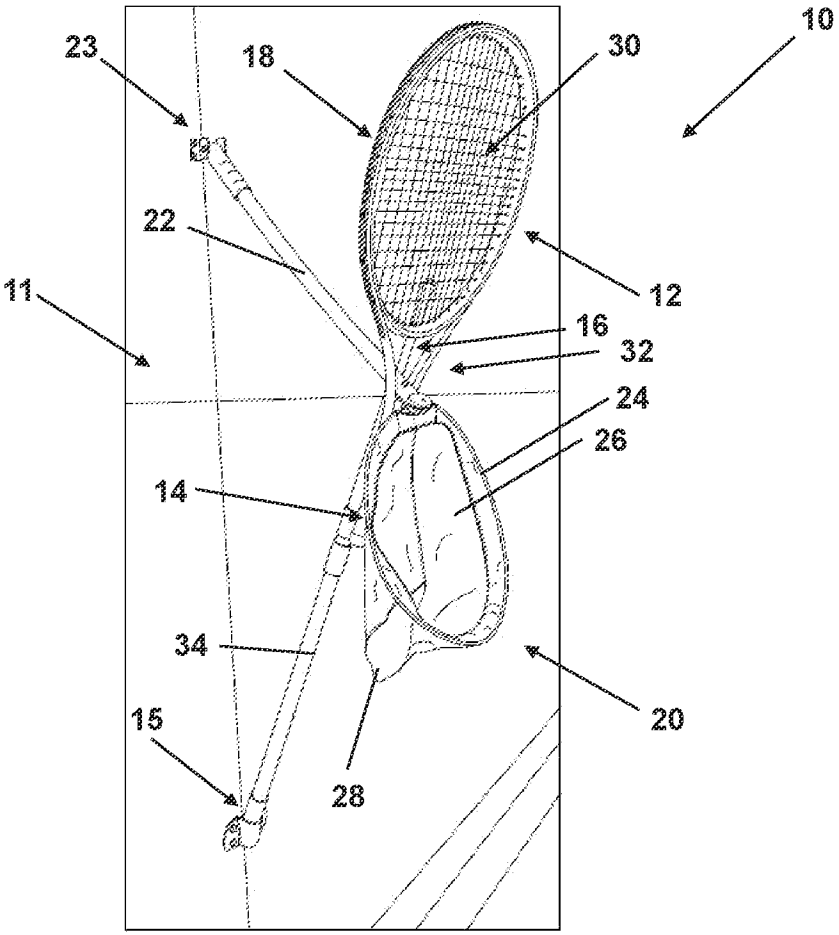
FIG. 1 is a perspective view of an assembly for use in ball-in-net game equipment.
Figure 2:
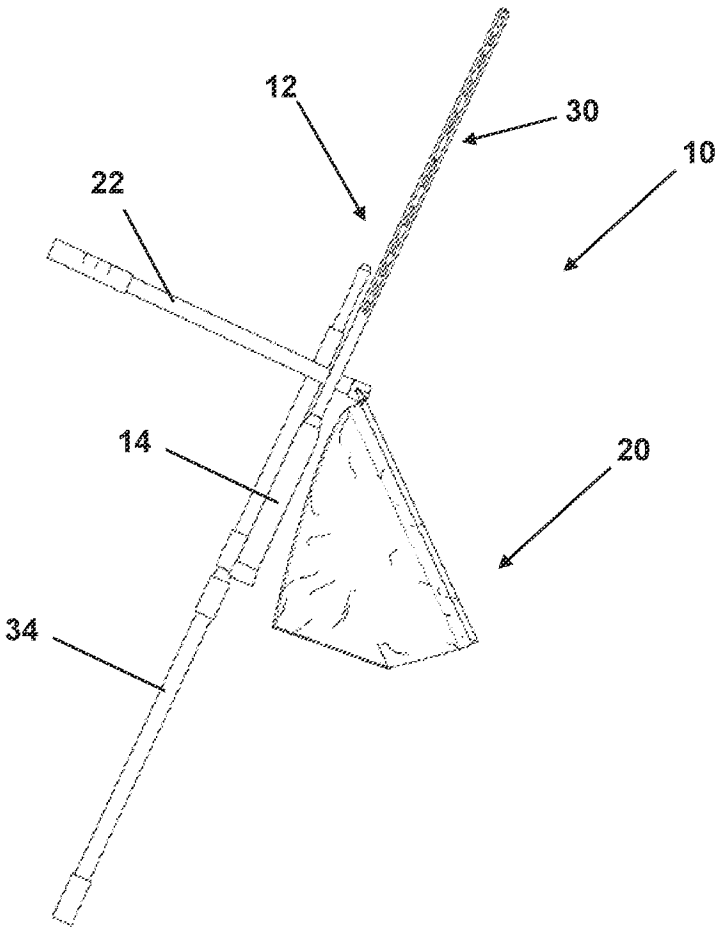
FIG. 2 is a side view of the assembly.

As illustrated in further detail in FIGS. 1 and 2, the game assembly 10 comprises a backboard component 12 and a net component 20. The backboard component 12 has a handle 14 and a head 18 connected by a shaft 16. A handle extension 34 can be secured to the backboard handle 14 to extend a length of the handle 14 for mounting. For example, the backboard component 12 may comprise a tennis racket where the shaft 16 is an open throat and the handle extension 34 is secured thereto with a fastener 36. The net component 20 has a handle 22 connected to a net ring 24 which supports a net 26 thereon. The net 26 may have an open end 28 formed by a hole such that a ball passes through the net ring 24 into and through the net 26. For example, the net component may comprise a butterfly net or a fishing net modified to add a hole 28 at the base of the net 26 opposite the net ring 24.

The handle 22 of the net component 20 is inserted into the open throat 16 of the backboard assembly from a front, game play surface 30 of the backboard component 12. The handle 22 is inserted through the open throat 16 up to the net ring 24 such that the net ring 24 meets sides of the open throat 16 and the components 12 and 14 are then securable at this connection point 32 to fix the assembly 10 in a selected orientation. The handle 22 and the handle 14 of the backboard component both extend from a same side of the assembly which is opposite the game play surface 30.

The handles 22 and 14 and/or 34 extend rearwardly from the game play surface 30 in opposing directions such that overall, the assembly takes a "X" shape with respect to the positioning of the backboard component 12 and the net component 14 crossing at the junction of the open throat 16 and net ring 24. The handle 22 and handle 14 with handle extension 34 may be the same or different lengths. In the embodiment illustrated the handle extension 34 is adjustable to change the length of the handle extension 34 and thus adjust the overall length of the backboard component 12. The overall length of the backboard component 12 and the net component 20 are different with the backboard component 12 having a greater overall length than the net component 20.

A distal end 23 of the handle 22 and a distal end 15 of the handle 14 or handle extension 34 may be mounting ends 15 and 23 for mounting the assembly 10 to a mounting surface 11. The mounting ends 15 and 23 may be secured to an upright or other surface using bolts, screws or other suitable mechanical fasteners or adhesive strips, adhesive straps, or any combination thereof. By the term bolt or screw is meant a fastener having helical threads along at least a portion of the shaft with one end being engageable by a tool to rotate the bolt or screw. Alternative mounting mechanisms may include mounting brackets using tacks. The upright surface can be a wall or substantially any upright surface and need not be flat or even substantially vertical. The angle between the head 18 and neck ring 24 at the connection point 32 can be adjusted and may be about 90 degrees but in one or more embodiments may be greater than about 90 degrees and less than about 180 degrees or may be less than about 90 degrees. Adjustment of this angle may be carried out by selecting positions and/or a spacing between mounting locations for each mounting end 15 and 23.

As mentioned briefly above, during assembly, the connection point 32 may be secured in a selected position. Securing the positioning of the backboard component 12 with respect to the net component 14 may be done by mounting the assembly 10 to the mounting surface 11 as described above and/or by using a fastener, clip, or adhesive strip to secure the assembly 10 at the connection point 32.

In one or more embodiments, the assembly 10 can be used for game play where the head 18 is a stringed head where the stringed surface is used as a backboard or rebound surface for a game ball with a goal of getting the ball to pass through the net ring 24 and thus into or through the net 26.

In one or more embodiments, a length of the handle 22 of the net component 14 may be in the range of about 12 inches to about 36 inches. In one or more embodiments the backboard component 12 may have an overall or total length in the range of about 16 to about 27.5 inches.

Although the present disclosure has been described with reference to preferred embodiments, workers skilled in the art will recognize that changes may be made in form and detail without departing from the spirit and scope of the disclosure.

The invention claimed is:

1. A method of game play set up comprising:

inserting a first end of a handle connected to a net ring and net into a throat opening of a tennis racket until the net ring meets the throat opening;

securing the first end of the handle to an upright surface at a first location;

securing a distal end of a handle of the tennis racket to the upright surface at a second location;

determining a distance between the first location on the upright surface and the second location on the upright surface to adjust the positioning of a head of the tennis racket with respect to a plane of the net ring wherein changing the distance between the first location and the second location adjusts the positioning of the head of the tennis racket with respect to the plane of the net ring; and securing the adjusted positioning of the head of the tennis racket with respect to the plane of the net ring by securing a junction of the first end of the handle connected to the net ring and net in the throat opening of the tennis racket with a fastener, clip, adhesive strip, or combination thereof.

2. The method of claim 1 and further comprising securing a handle extension to the handle of the tennis racket to change a length of the handle of the tennis racket and adjusting the overall length of the tennis racket.

3. The method of claim 1 and further comprising securing handle connected to the net ring and the handle of the tennis racket to the first and second location respectively with an adhesive strip.

4. The method of claim 1 and further comprising using the head of the tennis racket as a backboard for shooting a game ball into the net.

* * * * *